US007698821B2

(12) United States Patent
Ralph

(10) Patent No.: US 7,698,821 B2
(45) Date of Patent: Apr. 20, 2010

(54) LOCK MECHANISM FOR SPRING ASSISTED FOLDING KNIFE

(76) Inventor: Darrel Ralph, 4185 S. State St., Route 605, Galena, OH (US) 43021

( * ) Notice: Subject to any disclaimer, the term of this patent is extended or adjusted under 35 U.S.C. 154(b) by 165 days.

(21) Appl. No.: 11/307,053

(22) Filed: Jan. 20, 2006

(65) Prior Publication Data

US 2007/0169354 A1 Jul. 26, 2007

(51) Int. Cl.
*B26B 3/06* (2006.01)
*F41B 13/02* (2006.01)
*F41C 27/18* (2006.01)

(52) U.S. Cl. ..... 30/160; 30/158; 30/159; 30/161; 30/162

(58) Field of Classification Search ..... 30/160, 30/161, 319, 164.95, 365, 114, 307, 162; 7/118, 119, 120
See application file for complete search history.

(56) References Cited

U.S. PATENT DOCUMENTS

| | | | | |
|---|---|---|---|---|
| 1,379,153 | A * | 5/1921 | Young | 30/276 |
| 4,541,175 | A * | 9/1985 | Boyd et al. | 30/161 |
| 5,111,581 | A * | 5/1992 | Collins | 30/161 |
| 5,325,588 | A * | 7/1994 | Rogers | 30/161 |
| 5,822,866 | A * | 10/1998 | Pardue | 30/161 |
| 6,079,106 | A * | 6/2000 | Vallotton | 30/161 |
| 6,256,888 | B1 * | 7/2001 | Shuen | 30/161 |
| 6,363,614 | B1 * | 4/2002 | Umstead et al. | 30/144 |
| 6,397,477 | B1 * | 6/2002 | Collins | 30/161 |
| 6,574,869 | B1 * | 6/2003 | McHenry et al. | 30/161 |
| 7,243,430 | B1 * | 7/2007 | Lerch | 30/160 |
| 2001/0016987 | A1 * | 8/2001 | Chen | 30/161 |
| 2003/0070299 | A1 * | 4/2003 | Frazer | 30/161 |
| 2003/0213134 | A1 * | 11/2003 | Sakai | 30/161 |
| 2004/0134075 | A1 * | 7/2004 | Chu | 30/161 |
| 2004/0158991 | A1 * | 8/2004 | Freeman | 30/161 |
| 2005/0044717 | A1 * | 3/2005 | Nishihara | 30/161 |
| 2005/0223562 | A1 * | 10/2005 | Pardue et al. | 30/161 |
| 2006/0026844 | A1 * | 2/2006 | Ping | 30/153 |
| 2006/0230620 | A1 * | 10/2006 | Steigerwalt et al. | 30/159 |

* cited by examiner

*Primary Examiner*—Ghassem Alie
*Assistant Examiner*—Bharat C Patel
(74) *Attorney, Agent, or Firm*—Smith Moore Leatherwood LLP; Thomas W. Epting

(57) ABSTRACT

The folding knife of the present invention includes a handle having first and second handle members that are maintained in spaced, parallel relation to one another by spacing elements that define a groove therebetween. The blade is pivotally attached to the handle at its tang portion and is movable into and out of the groove between its fully open and fully closed positions. A coil spring, or equivalent, may be interconnected between the tang and handle to provide an assisted opening mechanism. A blade lock includes a user actuated button that passes through an elongated slot formed through one of the handle members and through a circular opening formed through a bias plate that is positioned within the handle, and a plunger element that is spring biased in a direction transverse to the longitudinal axis of the blade.

6 Claims, 2 Drawing Sheets

LOCK MECHANISM FOR SPRING ASSISTED FOLDING KNIFE

BACKGROUND OF THE INVENTION

1. Field of Invention

The present invention relates generally to folding knives, and more particularly to spring assisted opening knives and the lock mechanisms associated therewith for locking the blade in either a fully open or fully closed position.

2. Description of Prior Art

Folding knives typically comprise a handle having a pair of spaced apart handle members defining a groove therebetween and a blade pivotally movable relative to the handle between fully open and fully closed positions. A locking mechanism is generally included with these folding knives to retain the blade in either its fully open or fully closed position. There are a variety of locking mechanisms that have been employed in the past.

Liner locks employ a leaf spring that is attached at one end to the inner surface of one of the handle members and cantilevers therefrom. When the blade is in either its fully open or fully closed position, the leaf spring is biased into engaged relation with the edge of the tang that prevents its pivotal movement. To disengage the liner lock, the spring is manually moved out of engagement with the blade and the blade is manually pivotally moved such that the spring contacts the side of the blade, but does not prevent its pivotal movement to its terminal position. Once the blade reaches its terminal position, the spring is biased into engaged relation with the edge of the blade preventing further movement.

Liner locks are effective at preventing movement of the blade, but are difficult to manipulate. In addition, where the opening of the blade may be assisted by a spring, such as is the case with a switch blade, the operator's fingers would get in the way of the blade's movement, thus creating a significant injury risk. Accordingly, liner locks are not advisable for folding knives utilizing a spring for assisted opening and/or closing of the blade.

Another typical type of blade lock is a spring biased plunger that engages the tang of the blade and prevents it from moving until manually disengaged. The plunger is biased into engaged relation with the tang and requires manual depression by the operator to take it out of engagement. Once the plunger is manually depressed, the blade is free to pivotally move between it terminal positions. Once in its terminal open or closed position, the plunger can be released and it will reengage the tang to prevent further movement of the blade.

The plunger type of lock is useful in spring assisted opening knives because it does not require placement of the operator's fingers in the line of blade travel. The drawback of the plunger style lock is that it can accidentally be depressed, thereby unexpectedly opening the blade. For instance, if the knife is placed in the operator's pocket, it is possible that the plunger will be depressed by the operator leaning against an object, reaching into his or her pocket, or by some other object in the operator's pocket. The unexpected opening of the blade presents an undesirable injury risk.

3. Objects and Advantages

It is therefore a principal object and advantage of the present invention to provide a blade lock for a folding knife that prevents a low possibility of inadvertent blade opening.

It is another object and advantage of the present invention to provide a blade lock for a folding knife that permits the lock to be disengaged without placing the operator's fingers in the line of blade travel.

It is a further object and advantage of the present invention to provide a blade lock for a folding knife that can be incorporated into folding knives without significantly altering their dimensions.

Other objects and advantages of the present invention will in part be obvious, and in part appear hereinafter.

SUMMARY OF THE INVENTION

In accordance with the foregoing objects and advantages, the present invention provides a blade lock for use in combination with a folding knife. The folding knife of the present invention includes a handle comprising first and second handle members that are maintained in spaced, parallel relation to one another by spacing elements and that define a groove between them. The blade is pivotally attached to the handle at its tang portion and is movable into and out of the groove between its fully open and fully closed positions. A coil spring, or equivalent, may be interconnected between the tang and handle to provide an assisted opening mechanism.

The blade lock comprises a user actuated button that passes through an elongated slot formed through one of the handle members and through a circular opening formed through a bias plate that is positioned within the handle, and a plunger element that is spring biased in a direction transverse to the longitudinal axis of the blade. The plunger element has a first end and a second end. A portion of the plunger element is movable between engaged and disengaged relation relative to one of two cutout portions formed in the tang. The second end is positioned in contacting relation to the biasing spring and engages a recess formed on the inwardly facing surface of the handle member that is opposite the user actuated button. The blade lock further includes an elongated spring member that is positioned between the bias plate and a spring block that is fixed relative to the handle and includes a cavity formed in outwardly facing surface that receives the spring and bias plate therein. The bias plate includes an opening formed through its forward end (and through which the user actuated button extends) and an inwardly extending flange formed on its rearward end that engages the end of the spring.

The elongated spring biases the bias plate which, in turn, biases the user actuated button such that the user actuated button is positioned to the rearward end of the elongated slot formed through the handle member (which could be considered a "first position"). When in this position, the user actuated button cannot be depressed as it is out of alignment with the opening formed through the spring block. Thus the spring block prevents depression of the user actuated button. With the user actuated button being blocked from being depressed, it cannot engage the plunger element in order to take it out of engagement with the tang. Therefore, the plunger element remains in biased engagement with the tang, preventing movement of the blade.

In order to disengage the plunger element from the tang, the user actuated button must be manually slid forwardly along the elongated slot, overcoming the bias force created by the elongated spring, and once in the forward-most position in the slot, it can be depressed. When in the forward-most position within the slot (which could be considered a "second position"), the user actuated button is axially aligned with the opening formed thorough the spring block and the plunger element. Depression of the user actuated button permits it to pass through the spring block and into engagement with the inward end of the plunger. The manual movement of the user actuated button must be sufficient to overcome the bias force created by the spring that places the outer end of the plunger element into engagement with the tang, and once that bias force is overcome, the outer end of the plunger element disengages from the tang which could be considered a "third position"), thereby permitting pivotal movement of the blade from its closed to its open position, or vice-versa. If the knife is equipped with a spring that creates an opening force on the blade, the user's fingers will remain out of the line of travel of the blade, thus preventing inadvertent injury.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
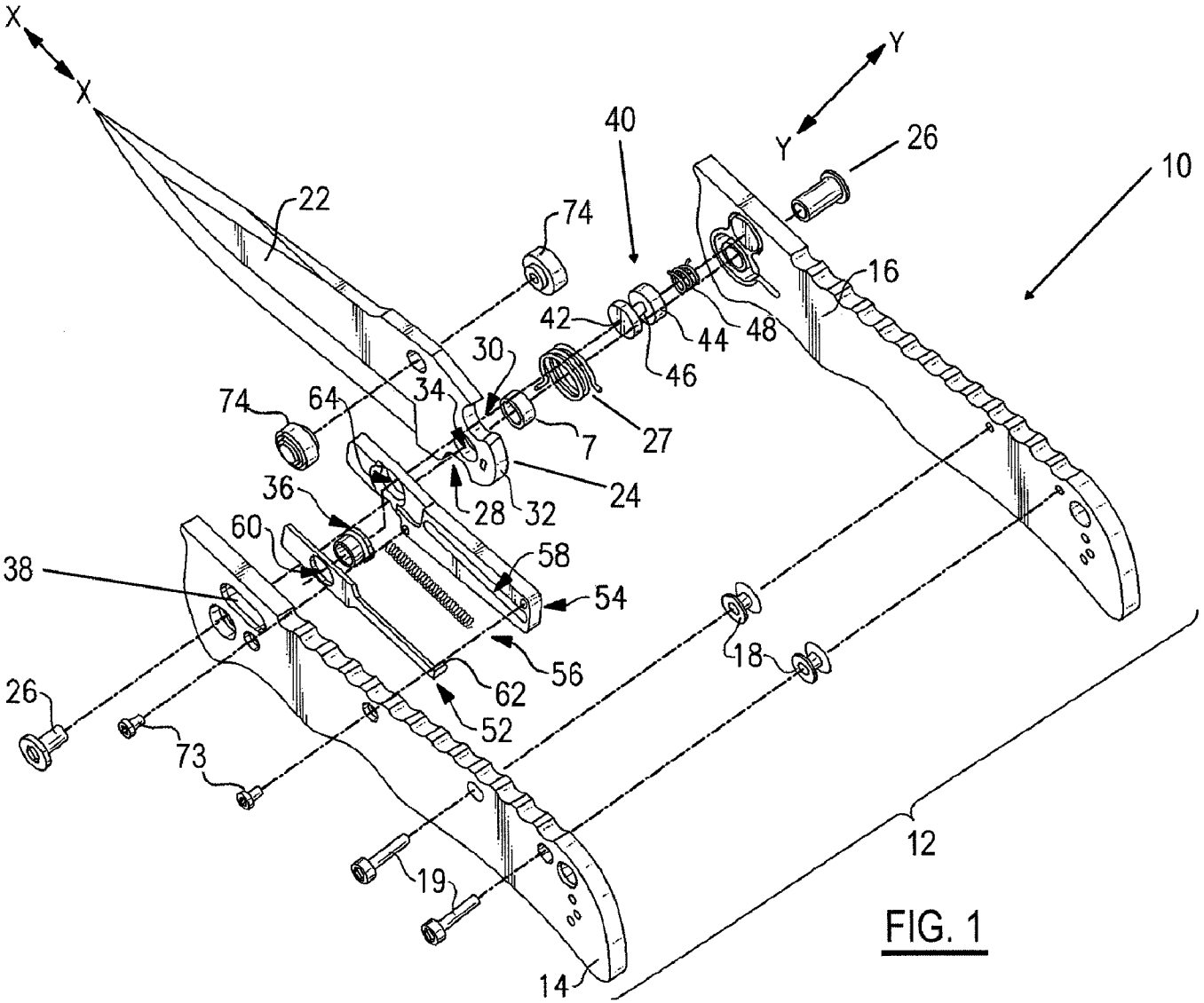
FIG. 1 is an exploded perspective view of the present invention.
Figure 2:
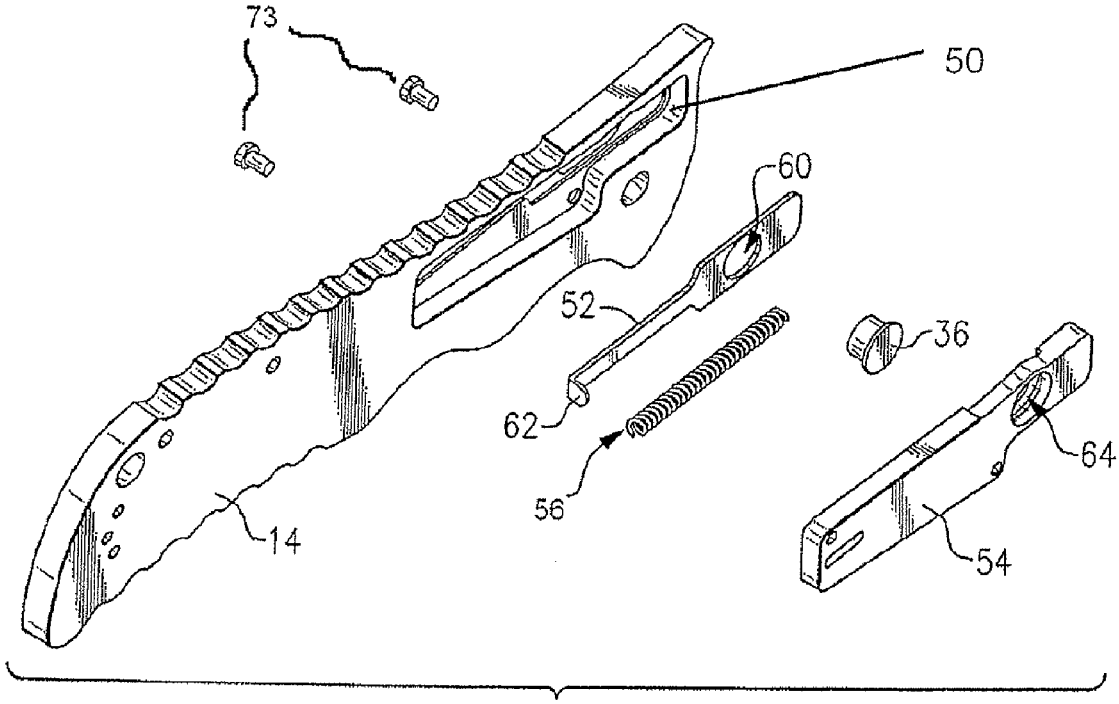
FIG. 2 is an exploded perspective view of a portion of the lock assembly associated with the present invention.

Referring now to the drawings, wherein like reference numerals refer to like parts throughout, there is seen in FIG. 1 a folding knife, designated generally by reference numeral 10, comprising a handle 12 composed of first and second handle members 14, 16, respectively, that are held in spaced, parallel relation to one another by spacer elements 18 and assembly screws 19, and define a groove 20 therebetween. Folding knife 10 further comprises a blade 22 attached at its tang 24 to handle 12 by pivot pin 26 for pivotal movement between terminal open (operable) and closed (within groove 20) positions. A pivot bushing 7 is also shown. A spring 27 has a first end secured to tang 24 and a second end secured to handle 16. Spring 27 produces an opening force to blade 22 when blade 22 is unlocked. Such spring actuated blades are well understood in the art. Folding knife 10 is elongated and extends along longitudinal axis X-X. Blade stop portions 74 fit together and are structured to stop the blade 22 in the terminal open position.

Tang 24 includes a pair of notches 28, 30, cut out from opposing sides thereof. Notches 28, 30 have a predetermined radius and are interconnected by the rounded end 32 of the tang. Pivot pin 26 passes through an opening 34 formed centrally through tang 24 and equidistant from notches 28 and 30.

Knife 10 further comprises a blade lock assembly for locking blade 22 in either its fully open or fully closed positions. The blade lock assembly comprises a user actuated button 36 that extends along an axis Y-Y that is transverse to axis X-X and through an elongated slot 38 formed through handle member 14. The lock assembly further comprises a barrel-shaped biased lock cylinder 40 that includes a first end 42, a second end, and an intermediate portion 46 joining first end 42 and second end 44. A portion of the barrel-shaped biased lock cylinder 40 is movable into and of engagement with notches 28 and 30. A spring 48 is positioned between second end 44 and the inner surface of handle member 16 to produce a bias force to cylinder 40 along axis Y-Y that positions second end 44 in engaged relation with notch 28 or 30. User actuated movement of button 36 along axis Y-Y causes it to engage first end 42 which in turn moves second end 44 out of engagement with notch 28 or 30, thereby causing blade 22 to move via spring force to its open position or by manual force to its closed position. Once moved from its open to closed or closed to open position, and a release of button 36 causes a portion of the barrel-shaped biased lock cylinder 40 to engage notch 28 or 30 due to the bias created by the spring 48.

Blade lock assembly further comprises structure that prevent button 36 from being accidentally or inadvertently moved along axis Y-Y, thus causing spring to automatically open blade 22. In particular, the lock assembly includes a cavity 50 that is formed in the inner surface of handle member 14, a bias plate 52 that is positioned within cavity 50 for sliding movement along an axis that is parallel to axis X-X, a block 54 that is positioned within cavity 50 and sandwiches plates 52 between itself and handle member 14, and a spring 56 positioned within a cavity 58 formed in the surface of block 54 facing handle member 14. Screws 73 hold block 54 and bias plate 52 in between the first and second handle members 14, 16, respectively.

Bias plate 52 includes a first end with an opening 60 formed therethrough, and a second end with a flange 62 extending inwardly therefrom. Flange 62 is positioned in engaging relation to the rearward end of spring 56, and user actuated button 36 passes through opening 60. Spring 56 creates a bias force on flange 62 along an axis parallel to axis X-X that causes flange 62 to be positioned in the rear-most point within cavity 58 when unbiased. For reasons explained hereinafter, this rear-post positioning of flange 62 within cavity 58 prevents inadvertent movement of button 36 along axis Y-Y, thereby preventing accidental opening of blade 22.

Block 54 includes elongated cavity 58 formed towards its rearward end, and further includes an opening 64 formed through its forward end. First end 42 of lock cylinder 40 is positioned within opening 64 when in its unbiased condition (i.e., when spring 48 is uncompressed thus placing second end 44 in engagement with notch 28 or 30, and locking blade 22 in either its fully open or closed position.)

In order to disengage second end 44 from notch 28 or 30, a user must first slide button 36 along an axis that is parallel to axis X-X and with enough force to overcome spring 56. When button 36 is in its forward-most position within slot 38, it is axially aligned with opening 64 (which lies along axis Y-Y). Without releasing the pressure that is required to overcome spring 56, the user must then depress button 36 along axis Y-Y. When depressed, button 36 passes through opening 64 and into engagement with first end 42. By continuing to depress button 36 with enough force to overcome the bias created by spring 48, second end 44 disengages from notch 28 or 30, placing intermediate portion 46 in non-interfering relation with blade 22, and permitting blade 22 to move from its open to its closed position, or vice-versa.

Figure 3:
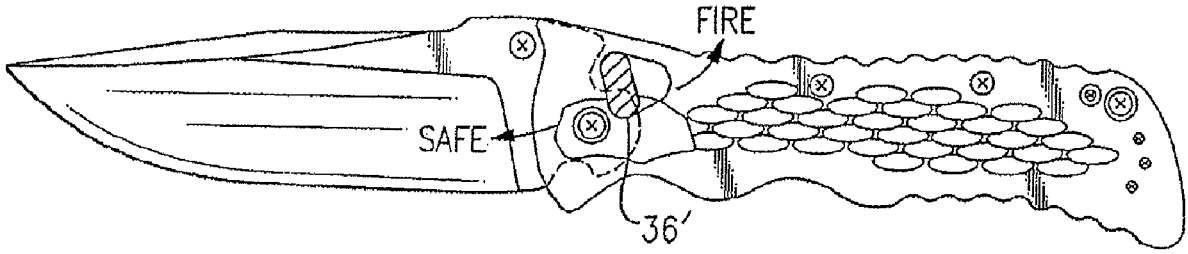
FIG. 3 is a partial perspective view of an alternate embodiment of the actuating button associated with the present invention.

An alternate embodiment of actuating mechanism for the lock assembly is illustrated in FIG. 3. In this alternate embodiment, button 36' is pivotally biased instead of slidingly biased as in the primary embodiment. To disengage blade 22 using button 36', it is necessary for the user to pivotally move button 36' sufficiently to overcome the spring bias force. While not releasing button 36' after its pivotal movement, it can then be depressed along axis Y-Y as with the primary embodiment. The same block and slide mechanism used with the primary embodiment are used with this alternate embodiment with the sole difference being the positioning and shape of the slot in which the spring resides.

What is claimed is:

1. A knife comprising:

a handle;

a blade that is rotatably connected to the handle, with the rotation between the handle and the blade defining a plane of rotation;

locking hardware adapted to lock and unlock the relative rotational motion of the blade and handle, the locking hardware comprising:

a user interface surface moveable relative to the handle between at least a first position, a second position and a third position, with the movement between the first position and the second position being at least substantially in a plane at least substantially parallel to the plane of rotation, and with the movement between the second position and the third position being in a direction that is at an angle substantially perpendicular to the plane of rotation, a lock structure, located or connected to unlock the relative rotational motion of the blade and handle only when the user actuation surface is in the third position, first biasing hardware structured, located or connected to bias the user interface surface from the third position towards the second position, and second biasing hardware structured, located and/or connected to bias the user interface surface from the second position towards the first position, so that when no force is applied to the user actuation surface, said user actuation surface will move to the first position through second position, wherein said second biasing structure comprises a bias plate having a length extending at least substantially in a plane parallel to the plane of rotation, having a first end portion with a first hole formed therethrough, and a block having a length extending at least substantially in a plane parallel to the plane of rotation, having a first end portion with a second hole formed therethrough.

2. The knife of claim 1, wherein said lock structure comprises a biased lock cylinder defining a lock cylinder central axis and a lock cylinder axial direction, with the lock cylinder comprising a first end, a middle portion and a second end, with the middle portion having a smaller lock cylinder axial cross sectional area than the first end, with the middle portion having a smaller lock cylinder axial cross sectional area than the second end, and with the middle portion being located between the first end and the second end with respect to the lock cylinder axial direction.

3. The knife of claim 2, wherein said lock cylinder axial direction is in a direction that is at said angle to the plane of rotation.

4. The knife of claim 3, wherein said first biasing hardware further comprises a spring extending along said bias lock cylinder axial direction and positioned in biased relation to said second end of said biased lock cylinder.

5. The knife of claim 2, wherein said bias plate further comprises a second end portion with a flange extending therefrom, wherein said user interface surface is moveable in a direction through said first hole.

6. The knife to claim 5, wherein said block further comprises a first surface with a cavity formed therein, said first end of said biased lock cylinder being movably positioned within said second hole, said flange positioned within said cavity; and a spring positioned within said cavity and having a first end positioned in contacting relation to said flange.

* * * * *